United States Patent [19]

Finnell

[11] Patent Number: 4,830,220

[45] Date of Patent: May 16, 1989

[54] LIQUID PROPORTIONER WITH FILTERING SYSTEM

[75] Inventor: James H. Finnell, Gilman, Ill.

[73] Assignee: Purdy Proportioners, Ltd., Belmont, Wis.

[21] Appl. No.: 49,799

[22] Filed: May 15, 1987

[51] Int. Cl.[4] ..... B67D 5/34

[52] U.S. Cl. ..... 222/57; 210/438; 210/430; 222/189; 222/386.5

[58] Field of Search ..... 210/438, 445, 430; 222/57, 386.5, 145, 189

[56] References Cited

U.S. PATENT DOCUMENTS

| | | | |
|---|---|---|---|
| 1,058,113 | 4/1913 | Stuckel | 210/445 |
| 1,638,066 | 8/1927 | Smythe | 210/438 |
| 3,023,905 | 3/1962 | McDougal et al. | 210/438 |
| 3,053,419 | 9/1962 | Palmer | 222/189 |
| 3,113,700 | 12/1963 | Chaffee et al. | 222/189 |
| 4,035,304 | 7/1977 | Watanabe | 210/445 |

*Primary Examiner*—H. Grant Skaggs

*Attorney, Agent, or Firm*—Pearne, Gordon, McCoy & Granger

[57] ABSTRACT

A liquid proportioner is disclosed in which the interior of a flexible bladder located within a tank provides a concentrate reservoir and a dilutant reservoir is provided exteriorly of the bladder. Because the bladder is flexible, the concentrate and the dilutant are maintained at the same pressure. A first orifice system connects with the dilutant reservoir and a second orifice system connects with the concentrate reservoir. An elongated, tubular filter is located within the concentrate reservoir and operates to remove any solids from the concentrate which would otherwise cause clogging of the concentrate orifice system. Because the pressure of the dilutant and concentrate is maintained equal, the level of the concentrate within the concentrate reservoir remains above the upper end of the filter until the supply of concentrate is virtually exhausted. This ensures that the total area of the filter is available for filtering during the entire operation of the proportioner.

8 Claims, 2 Drawing Sheets

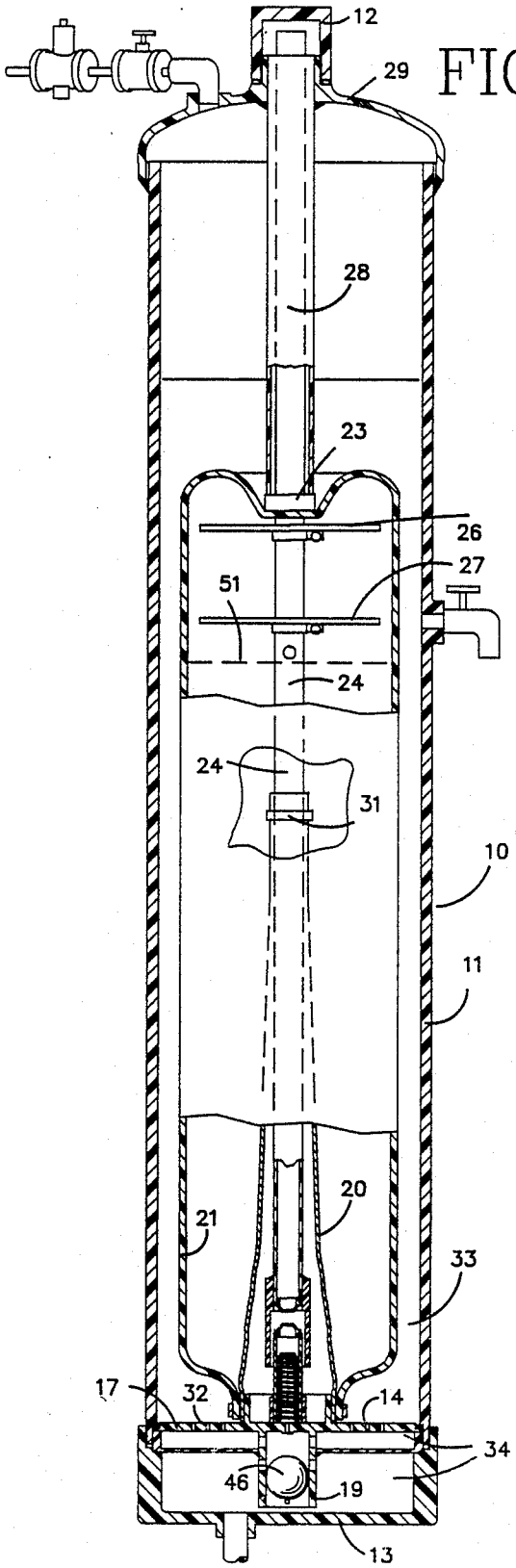
FIG. 1
FIG. 2
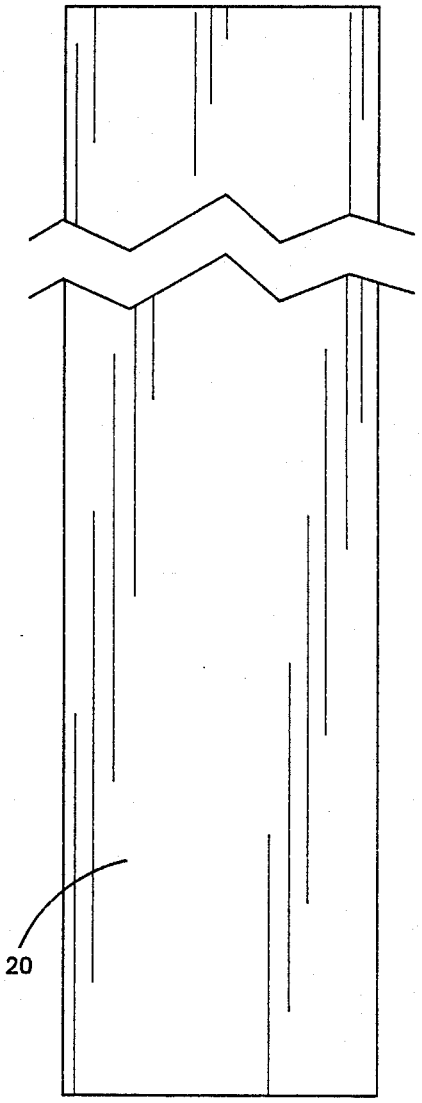

LIQUID PROPORTIONER WITH FILTERING SYSTEM

BACKGROUND OF THE INVENTION

This invention relates generally to liquid proportioning devices for dispensing a mixture of two liquids, and more particularly to a novel and improved liquid proportioner capable of providing reliable operation even when one of the liquids contains suspended material which tends to clog small orifices.

PRIOR ART

U.S. Pat. Nos. 3,809,291; 4,193,515; and 4,193,516, all assigned to the assignee of the present invention, disclose systems for accurately mixing two liquids in a predetermined ratio. Such systems may be used for adding medication or nutrients to the drinking water of livestock, poultry, or the like. All of such patents are incorporated herein in their entirety by reference to describe in detail the structure and overall mode of operation of these types of proportioners.

In each of these patents, a proportioner is disclosed having a flexible bladder positioned within a tank. The bladder provides a concentrate reservoir within the tank and dilutant, normally water, is supplied to the portions of the tank surrounding the concentrate reservoir which constitute the dilutant reservoir. Because the bladder is flexible, the pressure of the two liquids is equalized.

The unit also provides a mixing chamber connected to the concentrate reservoir by a first orifice system and to the dilutant reservoir by a separate second orifice system. The two orifice systems accurately meter the two liquids in a predetermined ratio so that the mixture of the two liquids supplied to the mixing chamber is accurately maintained. Such systems function reliably in most cases; however, some concentrates contain suspended solid material which tends to clog the concentrate orifice system. When this occurs, the flow of concentrate is decreased, and the resulting mixture contains less concentrate than desired.

It is believed that in some instances, such suspended solids are fillers sometimes added to medication or nutrients by manufacturers. In other instances, the temperature of the water supplied as a dilutant is very cold and causes precipitation of some components of the concentrate.

SUMMARY OF THE INVENTION

In accordance with the present invention, a novel and improved liquid proportioner is provided which reliably functions to accurately mix two liquids in a predetermined ratio, even when the concentrate contains solid material which tends to clog the orifice metering system associated therewith.

In the illustrated embodiment, a relatively long, tubular filter is positioned within the concentrate reservoir to remove from the concentrate any suspended material which would tend to clog the associated orifice system. The lower end of the filter is clamped between the lower end of the bladder and the bladder mounting flange on the orifice system. The upper end of the tubular filter is clamped against the filler tube. With such a mounting, the filter is easily installed in the total system and requires only one additional part, other than the filter itself, not already present in the system.

Further, the filler tube through which the concentrate is added to the concentrate reservoir cooperates to deliver concentrate only to the portion of the concentrate reservoir exterior of the filter, even though the filler tube extends longitudinally of the filter tube a substantial distance. Therefore, all of the concentrate is filtered before it reaches the concentrate orifice system, and clogging of such orifice system does not occur.

Further, the filter has a large area so that it can function for extended periods of time and filter large quantities of concentrate without itself becoming clogged. This is very important, since if the filter were to cause any pressure drop between the concentrate in the reservoir and the concentrate orifice system, the ratio of concentrate to dilutant in the resulting mixture would drastically change and would result in completely unsatisfactory operation of the system.

Still further, the entire filter area is available for filtering as the concentrate supply decreases. This is because the pressure of the dilutant on the outside of the flexible bladder causes the bladder to collapse inwardly as the supply of concentrate decreases and causes the level of the concentrate to remain above the entire filter.

Additionally, the filter is flexible so that the filler tube to which it is attached at one end can move vertically to perform a valving function during some operating conditions of the total system.

These and other aspects of this invention are illustrated in the accompanying drawings, and are more fully discussed in the following specification.

BRIEF DESCRIPTION OF THE DRAWINGS

FIG. 1 is a longitudinal section of a liquid proportioner incorporating the present invention;

FIG. 2 is an enlarged side elevation of the filter prior to its installation in the total system.

DETAILED DESCRIPTION OF THE DRAWING

Figure 3:
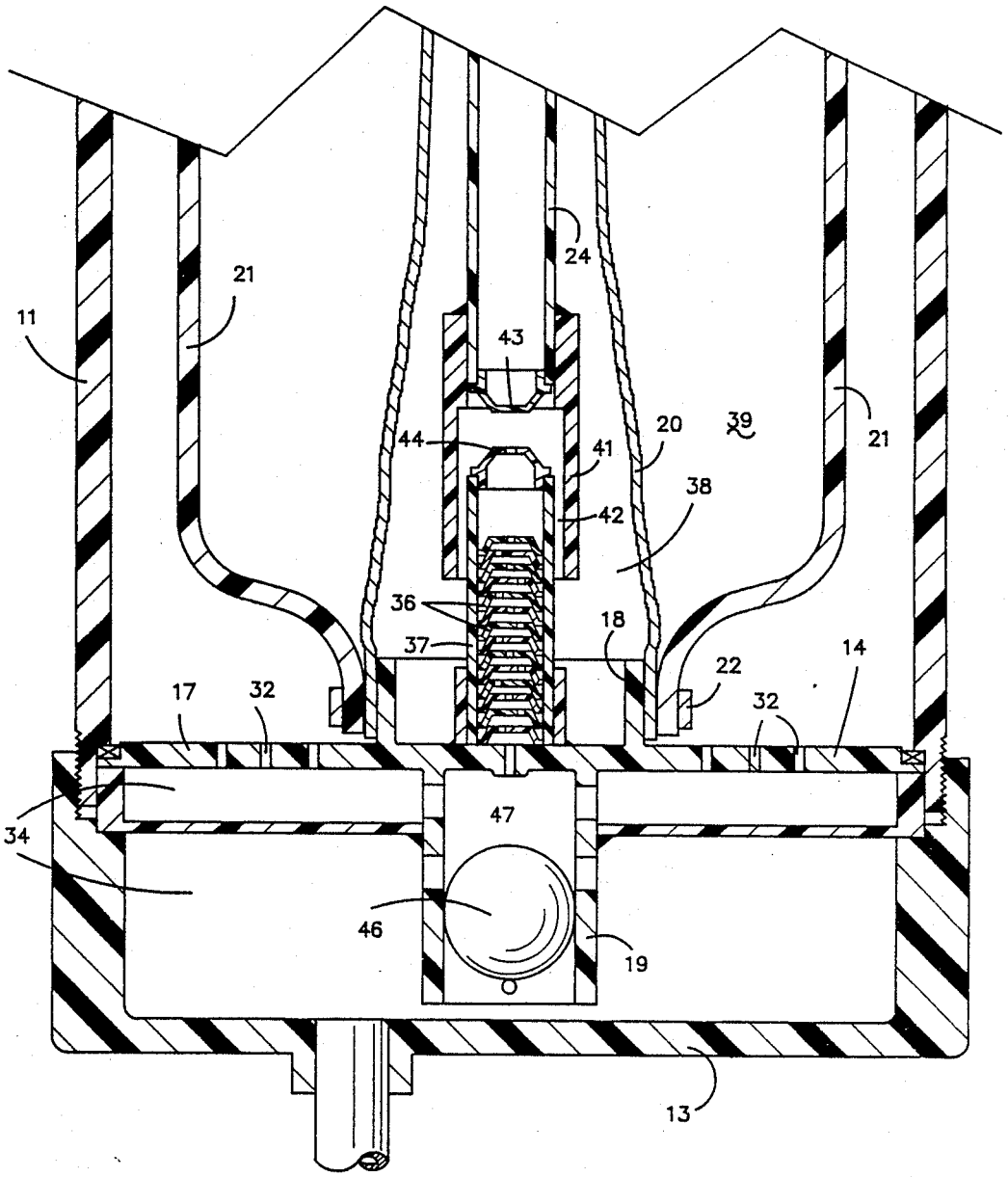
FIG. 3 is an enlarged longitudinal section of the lower end of the proportioner, illustrating the mounting of the lower end of the filter and one preferred structure of the metering orifice system.

The basic proportioner system illustrated in FIG. 1 is substantially the same as the proportioner system disclosed and claimed in U.S. Pat. No. 4,193,515, except that the proportioner illustrated in FIG. 1 is provided with a filter in accordance with the present invention.

The proportioner includes a housing assembly or tank 10 consisting of a cylindrical housing 11 closed at its upper end by an end cap 12, and at its lower end by a cup-shaped end cap 13. Preferably, the tank is formed of a reinforced plastic material, such as fiberglass or the like, which does not corrode.

Mounted in the lower end of the cylindrical housing 11 is an orifice assembly 14 which is secured in position when the end cap is threaded onto the lower end of the housing assembly.

The orifice assembly includes orifice plate 17 providing an upwardly extending, centrally located mounting flange 18 and a downwardly extending, centrally located flange providing a tubular valve guide 19.

A tubular filter 20 is positioned with its lower end 20*a* around the flange 18, and is secured thereto along with the lower end of a flexible bag or bladder 21 by a clamping band 22, so that the lower end of the bladder and the lower end of the filter form a fluidtight joint with the flange 18.

The upper end of the bag is clamped by a clamping band 23 against the exterior surface of a filler tube 24, and is held in fluidtight engagement therewith by such clamp. Mounted on the filler tube 24 within the bladder 21 are a pair of spaced bladder spreaders 26 and 27. The upper end of the filler tube 24 extends up into the closure cap 29 through an outer tube 28 secured at its upper end to the end cap 12 with a fluidtight joint. The clamp 23 is located with respect to the lower end of the outer tube 28 so that it limits upward movement of the filler tube during the operation of the proportioner to the position illustrated in FIG. 1.

The upper end of the filter is clamped against the filler tube by a clamp 31 at a location on the filler tube selected so that the filter 20 is substantially fully extended when the filler tube is in its uppermost operative position illustrated in FIG. 1. The filter, however, is flexible so that it does not interfere with downward movement of the filler tube to its concentrate shut-off position discussed below. The filter is preferably a nonwoven, clothlike material capable of providing substantially free passage of liquids while removing solids suspended in the concentrate, which could produce clogging of the concentrate orifices. Further, the filter 20 has substantial area so that it can function to filter substantial amounts of concentrate without itself being significantly clogged. One satisfactory filter is marketed by the Kendall Corporation, of Boston, Mass., under the trade name 'Webtrol' and is referred to as a breakproof milk sock. Such filters have been used extensively by the dairy industry for filtering milk.

Such filter is normally produced in a long, tubular shape, and is stitch-closed at one end for normal use in filtering milk. When used in the present proportioner, the stitching is merely cut off the end of the filter before it is clamped at its two ends, as described above. In its tubular condition, such filter provides a periphery about six inches long and has a length of about 23 inches, providing a total area of about 138 square inches. Although the particular filter described is given by way of example, it should be understood that this invention is not limited to that particular filter, except to the extent it is specifically defined in the claims.

The orifice plate 17 provides a plurality of dilutant orifices 32 which communicate in parallel between the dilutant chamber or dilutant reservoir 33 and the upper portion of the mixing chamber 34. Centrally located on the orifice plate 17 is a stack of series-connected orifice members 36 mounted within an orifice tube 37. These series-connected orifice members 36 communicate between the interior 38 of the filter 20 and function to meter the flow of concentrate from the concentrate reservoir 39 within the bladder 21.

Mounted on the lower end of the filler tube 24 is a filler tube extension 41 which fits down over the upper end of the orifice tube 37 to maintain the filler tube in alignment with the orifice tube 37. The tubular extension 41 is sized to loosely fit over the upper end of the orifice tube 37 and provide clearance 42, along which the concentrate is free to flow from the lower end of the interior 38 of the filter 20 to the upper end of the orifice tube 37, and thereafter down through the series-connected orifice members 36 into the mixing chamber 34.

A valve cap 43 mounted on the lower end of the filler tube 24 is spaced from an upper orifice member 44, as illustrated in FIGS. 1 and 3, during the normal operation of the proportioner. However, when insufficient dilutant is present within the dilutant reservoir 33, the filler tube drops down so that the valve cap 43 and the uppermost orifice member 44 engage to prevent further flow of concentrate. Similarly, a float valve 46 floats up into engagement with the lowermost orifice member 47 when the proportioner is not operating, to prevent mixing of the concentrate and dilutant at such time.

When the proportioner is operating to supply a mixture of dilutant and concentrate to the mixing chamber 34, the flow of the mixture overcomes the buoyancy of the valve member 46, and it moves to the position illustrated in the drawings. Also, air entrapped with the upper end of the bladder 21 provides sufficient buoyancy to lift the filler tube to its illustrated raised position during normal proportioner operation. For a more detailed description of the operation of the two orifice systems in establishing accurate proportioning of the concentrate and dilutant, reference should be made to the U.S. Pat. Nos. 4,193,515 and 4,193,516, referred to above.

Efficient filtering operation is achieved with the illustrated embodiment of the present invention because the full area of the filter functions at all times during the operation of the proportioner. As the concentrate flows from the interior of the bladder, the pressure of the dilutant in the dilutant reservoir 33 causes the bladder to collapse to maintain the concentrate pressure equal to the dilutant pressure. This causes the concentrate to attempt to seek its pressure level and maintain the upper surface 51 of concentrate substantially constant as the concentrate supply is depleted by flow to the mixing chamber. Consequently, the height of the concentrate within the bladder is maintained along the entire length of the filter 20 until the supply of concentrate is exhausted and the bladder has fully collapsed around the filler tube. Because the filter is flexible, it is not damaged when the bladder 21 collapses the filter in against the filler tube. Since the full surface area of the filter is available during all of the operation of the proportioner, a maximum filter life is achieved before the filter must be replaced.

The amount of concentrate that can be filtered with a given filter before the filter becomes clogged is, of course, a function of the amount of suspended solids contained in the particular concentrate being proportioned. When a filter becomes clogged and must be replaced, it is a simple matter to open the lower end of the tank by removing the end cap 13 so that the orifice bladder and filter subassembly can be removed from the tank. The clamp 22 is then released, and the bladder is pushed up along the filler tube to provide access to the upper clamp 31, to permit complete removal of the used filter. A new filter is then installed and clamped at its upper end and lower end and the tank is reassembled.

With the present invention, the provision of a filter requires only one additional element to this system other than the filter itself—the clamping band 23. Consequently, in accordance with the present invention, improved performance is achieved, with no significant increase in the total cost of the proportioner system.

Although the preferred embodiment of this invention has been shown and described, it should be understood that various modifications and rearrangements of the parts may be resorted to without departing from the scope of the invention as disclosed and claimed herein.

What is claimed is:

1. A liquid proportioner for dispensing a mixture of liquid concentrate and a liquid dilutant comprising a dilutant reservoir for a supply of dilutant, a concentrate reservoir for a supply of concentrate in pressure communication with said dilutant reservoir, a mixing chamber, first orifice means communicating between said dilutant reservoir and said mixing chamber, second orifice means communicating between said concentrate reservoir and said mixing chamber, said concentrate reservoir operating when provided with a discrete amount of concentrate to supply said concentrate to said second orifice means until said concentrate is substantially exhausted, a filler tube extending vertically along said concentrate reservoir and vertically movable within said proportioner, said filler tube providing valving means operable in response to vertical movement to close said second orifice means when insufficient dilutant is present for proper proportioning, and an elongated tubular flexible filter sealing with said filler tube at one end and sealing at its other end with said second orifice means, said filter extending a substantial distance along the length of said bag and providing an area which is a high multiple of the area of said second orifice means, said filter isolating said concentrate reservoir and said second orifice means so that concentrate reaching said second orifice means must first pass through said filter before reaching said second orifice means, said filter having sufficient area so that said concentrate passes therethrough without material pressure drop so that the concentrate flowing from said filter to said second orifice means is at substantially the same pressure as the concentrate within said concentrate reservoir, said filter preventing clogging of said orifice means caused by solids in said concentrate, said filter being sufficiently flexible to allow said filler tube to move vertically within said proportioner, said pressure communication between said reservoirs maintaining the level of said dilutant in said dilutant reservoir above said filter until the concentrate therein is substantially exhausted so that the entire surface of said filter operates to filter concentrate as concentrate flows from said concentrate reservoir.

2. A liquid proportioner as set forth in claim 1, wherein said filter is tubular having ends, said flexible bladder having ends, said filter and bladder being connected at one end to said orifice means to isolate said reservoirs and cause concentrate to flow through said filters before reaching said second orifice means.

3. A liquid proportioner as set forth in claim 2, wherein said one ends of each of said filter and bladder are connected to said orifice means by a single mounting device.

4. A liquid proportioner as set forth in claim 3, wherein a filler tube extends into said concentrate reservoir, the other end of said bladder and filter being secured to said filler tube at spaced locations, said filler tube providing passage means to supply concentrate to said concentrate reservoir exteriorly of said filter.

5. A liquid proportioner as set forth in claim 4, wherein said filler tube is vertically movable to close off concentrate flow when insufficient dilutant is present in said dilutant reservoir, and said filter is sufficiently flexible to permit said vertical movement.

6. A liquid proportioner as set forth in claim 2, wherein said bladder collapses inwardly toward said filter as concentrate flows through said second orifice means causing said concentrate to extend along the entire length of said filter until the supply of concentrate is substantially exhausted.

7. A liquid proportioner as set forth in claim 6, wherein said filter is a tubular, non-woven, clothlike flexible material open at both ends.

8. A liquid proportioner as set forth in claim 7, wherein said filter extends along said concentrate reservoir at least one-half of the height thereof.

* * * * *